United States Patent [19]

Ogden

[11] 4,445,683

[45] May 1, 1984

[54] EXERCISE TREADMILL WITH ROCKABLE FEET

[76] Inventor: Ralph Ogden, 1304 Fisher St., Munster, Ind. 46321

[21] Appl. No.: 378,627

[22] Filed: May 17, 1982

Related U.S. Application Data

[63] Continuation-in-part of Ser. No. 226,766, Jan. 21, 1981, Pat. No. 4,374,587, which is a continuation-in-part of Ser. No. 175,516, Aug. 5, 1980, Pat. No. 4,344,616.

[51] Int. Cl.[3] ..... A63B 23/06

[52] U.S. Cl. ..... 272/69; 272/DIG. 4

[58] Field of Search ..... 272/69, DIG. 4; 128/707; 119/29; 198/806, 841

[56] References Cited

U.S. PATENT DOCUMENTS

| | | | |
|---|---|---|---|
| 759,296 | 5/1904 | Moriarty | 272/69 |
| 2,399,915 | 5/1946 | Drake | 272/69 |
| 3,356,367 | 12/1967 | Tewksbury | 272/69 |
| 3,643,943 | 2/1972 | Erwin, Jr. et al. | 272/69 |
| 3,703,284 | 11/1972 | Hesen | 272/69 |
| 4,227,487 | 10/1980 | Davis | 119/29 |
| 4,364,556 | 12/1982 | Otte | 272/69 |

FOREIGN PATENT DOCUMENTS

| | | | |
|---|---|---|---|
| 2919494 | 11/1980 | Fed. Rep. of Germany | 272/69 |
| 1565616 | 3/1969 | France | 272/69 |
| 1565617 | 3/1969 | France | 272/69 |
| 221620 | 8/1942 | Switzerland | 272/69 |
| 556075 | 9/1943 | United Kingdom | 198/806 |

*Primary Examiner*—Richard T. Stouffer

*Attorney, Agent, or Firm*—McWilliams, Mann, Zummer and Sweeney

[57] ABSTRACT

A treadmill exercising apparatus comprising a generally planar frame equipped with a planar slider bed and head and tail rollers journalled respectively at the head and tail ends of the frame, over which an endless nylon belt is trained, with the slider bed having a top, slider, surfacing, formed by plastic sheeting, across which the upper run of the belt rides, and the head and tail rollers being formed from a rigid metallic material and provided with a belt centering crown, which in the case of the head roller is formed by an elastomeric material. The frame at its head end is equipped with a cross member in which are threadedly mounted in spaced apart relation a pair of threaded screw members that support the head end of the frame for adjustment of the slope of the treadmill. The tail end of the frame has a pair of pivotally connected supporting feet, and the feet of the frame tail end and the screw members are proportioned to horizontally dispose the slider bed and associated endless belt in the retracted position of the screw members, with the screw members being journalled to rotate about upright axes that are inclined at an acute angle off perpendicular relationship relative to the slider bed plane for sloping the treadmill as desired.

9 Claims, 16 Drawing Figures

10
29
25
104
122
126
136
142
180
182
184
186
192
280
282
284
285
286
287
289
290
291
292
294
306
310
236
272
7
3
13
12
42
54
340
204
201
211
203
207
208
206
209
202
18
4

EXERCISE TREADMILL WITH ROCKABLE FEET

This application is a continuation-in-part of my application Ser. No. 226,766, filed Jan. 21, 1981, now U.S. Pat. No. 4,374,587, granted Feb. 22, 1983, which was a continuation-in-part of my application Ser. No. 175,516, filed Aug. 5, 1980, now U.S. Pat. No. 4,344,616, granted Aug. 17, 1982.

This invention relates to an exercise treadmill, and more particularly to an exercise treadmill of the endless belt type.

Various forms and types of treadmill assemblies are available for exercise purposes involving endless belts. However, most commercially available equipment of this type is unduly expensive to be practical for individuals to have for home use, due to the tendency to incorporate sophisticated monitoring equipment and overdesign the basic apparatus to insure continuous exercise for individuals weighing up to two hundred fifty pounds or more and yet permit adjustment in slope and speed for making available to the user mild to exhaustive exercise for testing or conditioning purposes.

A principal object of the present invention is to provide a walking exercise treadmill of few and simple parts that avoids costly sophisticated instrumentation and other equipment not essential to exercise use as such, while providing the user with ready infinitely variable slope adjustment between zero and a predetermined maximum, such as twenty-five percent, and a suitable selection of belt speed adjustments.

Another principal object of the present invention is to provide an exercise treadmill that essentially comprises a slider bed type, endless belt trained, frame assembly characterized by the belt and slider bed surfacing it rides on being formed of plastic materials that are lubricant free, and providing for manually operable stepless slope selectability between zero and a predetermined maximum slope, with the frame support being arranged to automatically increase stability as the slope is increased to the maximum provided for.

Another important object of the invention is to provide an exercise treadmill that has minimal space requirements for storage and use, that has minimal driving energy requirements in use, that has nominal maintenance requirements, and that is long lived and effective in use.

In accordance with the invention, an exercise treadmill is provided comprising a generally planar frame providing a slider bed, and head and tail rollers at the corresponding ends of the slider bed, over which is trained and endless belt formed from nylon, the upper run of which rides on a lubrication free facing of the slider bed that is preferably formed from ultra high molecular weight polyethylene, the belt engaging surfacing of which is preferably sanded. The rollers are, on the other hand formed from rigid metallic materials and are provided with a belt centering crown which in the case of the head roller is formed by an elastomeric material. The treadmill frame adjacent to and spaced forwardly of its head end is provided with a cross member fixed thereto in which slope adjusting devices are provided comprising a pair of spaced apart screw members that are threadedly mounted for supporting and changing the elevation of the frame head end to provide the slope, if any, desired. Each screw member is individually rotationally journalled in its own supporting foot that is arranged for rocking relation of the screw members with respect to the treadmill supporting surface for the treadmill feet, and the screw members are mounted for rotation about upright axes that are at like acute angles with respect to the plane of the slider bed, which axes angle forwardly of the treadmill frame upwardly of the slider bed frame. The indicated acute angulation of the screw member axes equal the maximum angulation the slider bed frame is to have at its maximum slope to be provided for, which is approximately twenty-seven percent in a preferred embodiment of the invention. The upper ends of the screw members are coupled together by a manually operated drive chain arrangement for adjusting the elevation of the treadmill head end to provide the slope desired up to the indicated maximum slope. The tail end of the treadmill frame is equipped with a pair of pivotally mounted spaced feet, and the treadmill feet at both ends of the frame are proportioned so that the treadmill slider bed and cooperating endless belt are horizontally disposed when the screw members are in their retracted, maximum angulation, positions, with the slider bed and cooperating belt being angled upwardly at the predetermined maximum slope to be provided by the treadmill unit when the screw members are in their extended, substantially vertical relations.

The belt is power driven by a suitable electric motor carried by the treadmill frame cross member with stepped pulleys being provided for stepping down of the drive RPM and belt speed adjustment to provide belt movement at several selected speeds, such as 2, 2.9, and 3.5 miles per hour for walking exercise. The treadmill assembly or unit is equipped on either side of same with a hand hold railing of P shaped configuration of which the head of the railing configuration is positioned for grasping as needed by the user.

Hand crank operation of the screw members from their retracted relations to their extended positions both swings the screw members to a substantial vertical supporting position without changing their angular relationship relative to the treadmill slider bed, and angles the treadmill slider bed and endless belt trained thereover at the desired maximum slope provided for, which is at the same acute angle relative to the horizontal that the screw member axes are angled relative to the plane of the treadmill slider bed. The treadmill slider bed in moving between its horizontal and maximum inclined positions has pivotal action only at its feet, with its rear feet shifting forwardly as the frame moves from its horizontal to its maximum inclining position, and vice versa.

The screw members of the slope adjusting devices are threadedly mounted in the treadmill frame cross member by way of a pair of special nut assemblies associated therewith, each of which includes a tubular member of square section through which the screw member associated therewith passes, and first and second nut members respectively keyed to the lower and upper ends of the tubular frame which threadedly engage the screw member thereof. The nut members are formed from nylon and the screw members are formed from steel, with the threading thereof being roll formed. The upper nut member of each nut assemblies is mounted for lost motion movement relative to the nut assembly tubular member to accommodate tolerance variations in the screw member threading.

The belt drive assembly includes a motor mounting assembly arrangement that is spring biased to apply a essentially constant tension in the drive transmitting pulley belt involved, which is freed from overstressing, with the motor mounting assembly arrangement including a hand crank arrangement for manually overcoming such biasing means and freeing the pulley belt for ready changing of treadmill driving speeds.

Still other objects, uses and advantages will become obvious or apparent from a consideration of the following detailed description and the application drawings in which like reference numerals indicate like parts throughout the several views.

However, it is to be understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
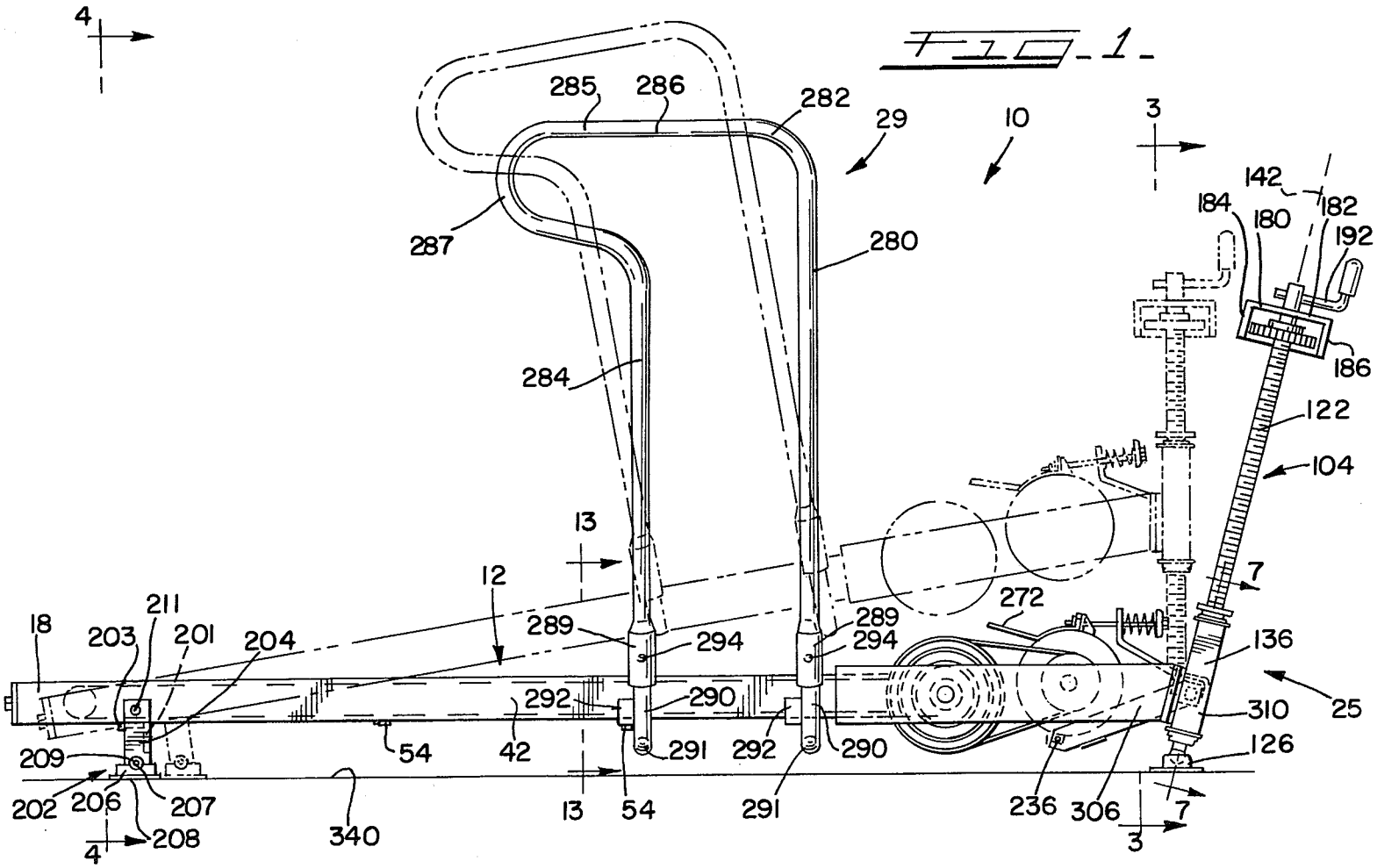
FIG. 1 is a side elevational view diagrammatically illustrating the preferred embodiment of the invention, showing the treadmill assembly in full lines at its zero slope position, and in phantom in its maximum slope position of the illustrated embodiment, which is 15 degrees relative to the horizontal or a twenty-five percent grade.
Figure 2:
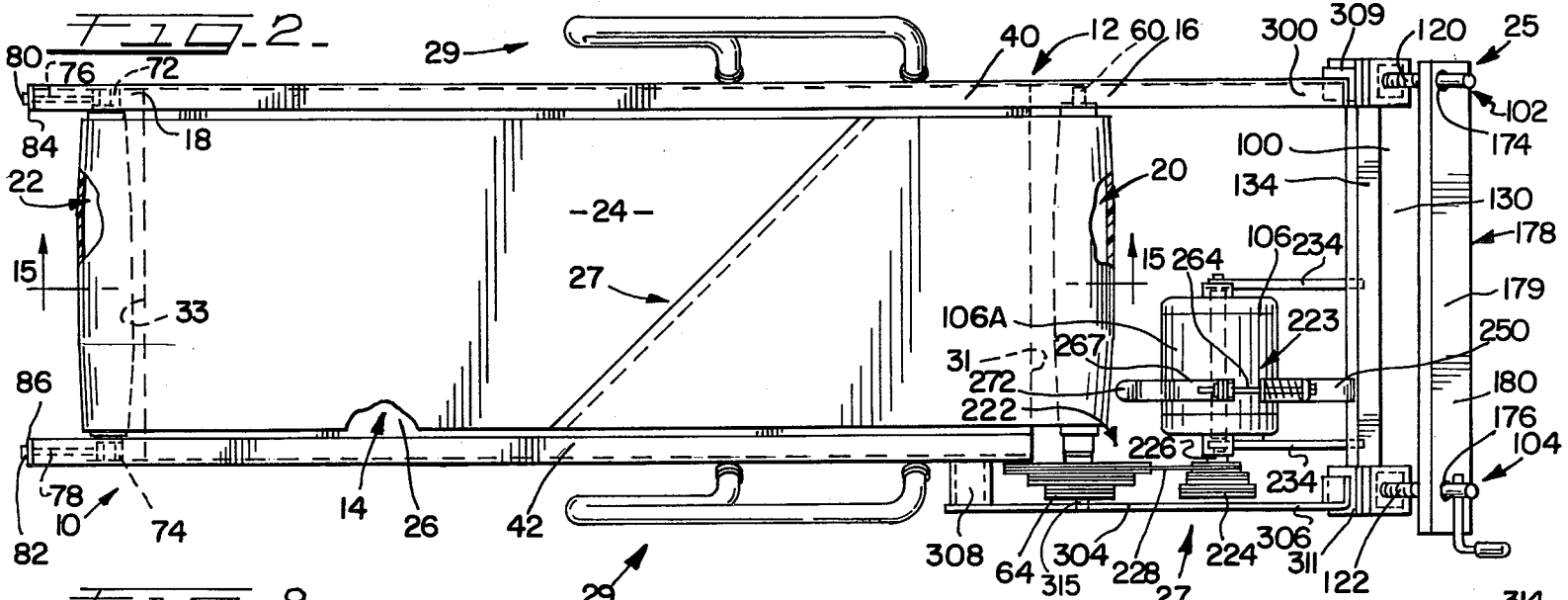
FIG. 2 is a top plan view of the treadmill assembly as shown in its full line position of FIG. 1, with parts broken away.

Reference numeral 10 of FIGS. 1 and 2 generally indicates a diagrammatically illustrated embodiment of the invention that follows the basic arrangement disclosed in my said application Ser. No. 226,766, filed Jan. 21, 1981 (the disclosure of which is incorporated hereby by this reference). For completeness of disclosure, the general arrangement of the apparatus 10 is repeated herein in conjunction with the improvements of the present invention.

The treadmill apparatus or unit 10 generally comprises a flat or planar frame 12 including a slider bed 14 extending between the forward or head end 16 of the frame and the tail or rear end 18 of the frame, head roller 20 that is journalled at the head or front end 16 of the frame, tail roller 22 that is journalled at the tail or back end 18 of the frame, and endless belt 24 that is trained over the slider bed 14 and the head and tail rollers 20 and 22. The frame 12 is equipped forwardly of head roller 20 with a slope adjusting device 25, whereby the user may manually adjust the slope of the treadmill between the two positions indicated in FIG. 1, and belt drive apparatus 27 that is carried by frame 12. Frame 12 also is equipped with side mounted hand holds 29 (see FIGS. 1, 2 and 4).

Figure 15:
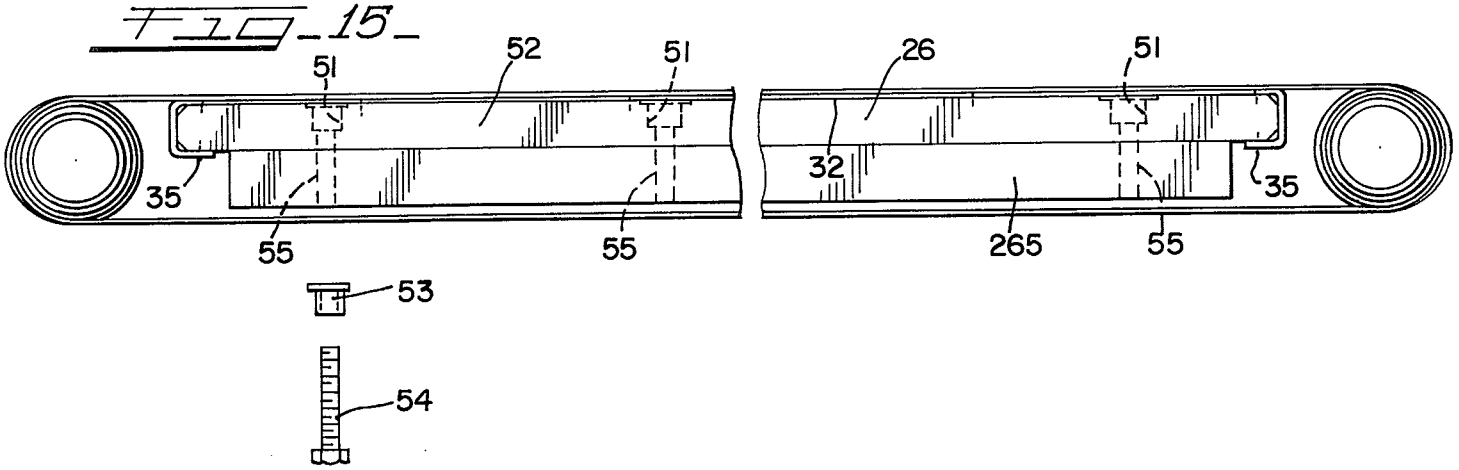
FIG. 15 is a side elevational view of the slider bed and belt trained over same, on an enlarged scale, with parts being broken away.

The slider bed 14 comprises a flat or planar sheet of plywood or the like 26 of rectangular outline and proportioned to extend substantially between the locations of the head roller 20 and the tail roller 22, with the slider bed ends being indicated in FIG. 2 at 31 and 33. The slider bed 14 has an upwardly facing surfacing 30 provided by a nonmetallic sheet 32 suitably affixed to sheet 26 as by being anchored thereto using staples or the like where indicated at 35 in FIGS. 15 and 16. The surfacing 30 should be sanded or abraded to reduce the load bearing area of same and form a multiplicity of grooves, and sheet 32 should be dry and free of any lubricant materials of either the wet or dry types.

Figure 16:
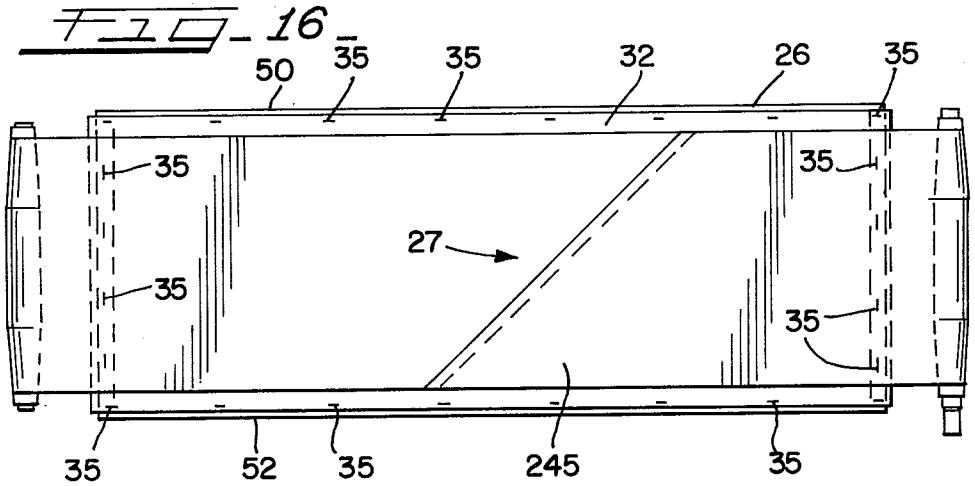
FIG. 16 is a top plan view of the slider bed and belt shown in FIG. 15.

The belt 24 is preferably formed from nylon and while the belt 24 may be in one piece loop form, it may also conveniently be formed from nylon sheeting 24S having its ends overlapped and fixed together employing a suitable adhesive, as indicated at 27 in FIGS. 2 and 16. Nylon sheeting for forming belt 24 and sheeting 24S may be provided using Firestone Rubber Company's nylon 228 product, Dupont's nylon 42 product, and the Rilsan Corp. (Burdsbough, Penn.) nylon II BESNO product. A thickness on the order of 0.2 inch is satisfactory for rollers 20 and 22 having maximum diameters (including the hereindescribed crowning) in the range of from about 1.5 to about 2.0 inches (both rollers have the same maximum diameter of 1.660 in a preferred embodiment).

Sheet 32 preferably is a length of ultra high molecular weight (UHMW) polyethylene, having the side of same forming surfacing 30 sanded; sheet 32 may be provided by the laminhard compression molding process available at Crown Plastics Company of Harrison, Ohio and preferably includes powdered carbon uniformly distributed throughout same that in amount lies in the range of from about 0.25 to about 0.5 percent by weight, for purposes of eliminating static electricity build ups in the treadmill belt and slider bed. Sheet 32 has a thickness, in the indicated preferred form, that lies in the range of from about 0.010 inch to about 0.025 inch. The surfacing 30 should be of the sanded or abraded type that is available for this product at Crown Plastics Company, though the sanding or abrading may be either longitudinally of or crosswise of the sheet 32.

It has been found that using nylon belting in combination with the slider bed surfacing 30 provided by the indicated UHMW polyethylene and sanded as indicated and free of any dry or wet lubricant surprisingly provides a slider bed type support for the belt upper run that has better antifriction characteristics than if the surfacing 30 were formed by canvas impregnated with such substances as wax or graphite. Standard weighted inclined plane coefficient of friction tests of the Applicant's treadmill employing as sheet 32 the indicated UHMW polyethylene material on which rides the indicated nylon 228, nylon 42, and nylon II products provide coefficients of dynamic friction of 0.075, 0.085, and 0.080, respectively. Applicant's studies of the performance of the disclosed treadmill using as belt 24 and sheet 32 the materials indicated as well as others less satisfactory materials have shown that the coefficient of dynamic or sliding friction of the nylon belt 24 on the UHMW sheet 32, and in particular, on its sanded surfacing 30, should be no more than about 0.15 to achieve the minimized drive energy requirements and head and tail roller bearing stress requirements that are major objects of the invention, in combination with the hereinafter described coefficient of static friction criteria provided at the treadmill head and tail rollers.

Instead of employing the indicated UHMW polyethylene to form sheet 32, the indicated nylon 228, nylon 42, and nylon II, or an acetal resin, such as Delrin, or their equivalents, may be employed, which will provide less advantages but still satisfactory and operable dynamic coefficient of friction characteristics that will lie in the range of from about 0.125 to about 0.145. However, the surface of such sheets that forms surface 30 preferably should be sanded (especially in the case of the preferred UHMW polyethylene) insofar as it is currently known, to reduce the load bearing area and increase the area loading of the sheet 32 as the user goes through his walking pace when using apparatus 10. This has the effect of reducing the coefficient of sliding friction involved, in line with the objectives of Applicant's invention.

The treadmill frame 12 further comprises a pair of opposed channel members 40 and 42 each of which comprises web portion 44 and spaced flanges 46 and 48. The slider bed 14 is formed to define longitudinally extending side edges 50 and 52 over which the respective frame members 40 and 42 are applied, with suitable bolts or screws 54 anchoring the slider board 14 (as equipped with the surfacing 30), to the frame members 40 and 42 at spaced points along the treadmill frame. In the form shown, wood sheet 26 has spacers 26S, formed from wood stripping or the like, applied in underlying relation to sheet 26, and sheet 26 is recessed at 51 to receive spaced "T" nuts 53, and bored as at 55, to receive the bolts or screws 54 that secure these parts together (see FIGS. 1, 4, 13 and 15).

The end 300 of frame member 40 extends fowardly of the apparatus for association with slope adjusting device 25, and frame member 42 is equipped with mounting plate 304 for the same purpose, plate 304 being suitably secured to frame member 42 by employing a fabricated connecting block 308 that is welded or otherwise secured to both plate 304 and channel member 42 at its web portion 44.

Figure 9:
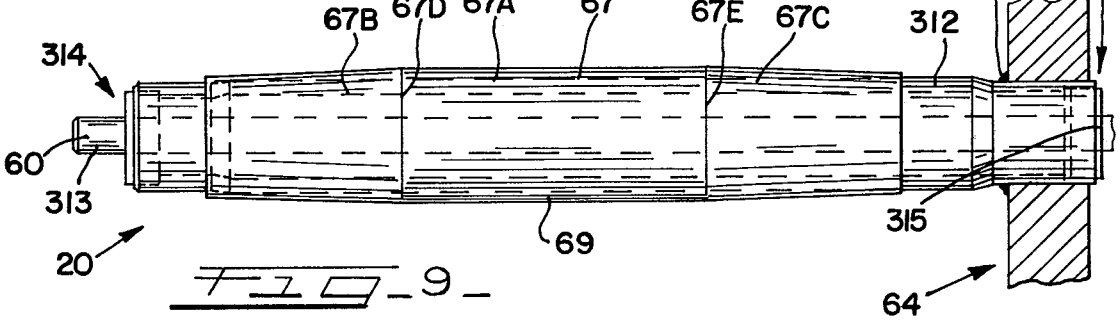
FIG. 9 is a fragmental plan view of the treadmill head roller and its associated drive pulley; with parts broken away.

The head roller 20 comprises (see FIG. 9) roller shell 312 journalled on shaft 60 by suitable ball bearing units 314 at either end of same. Shaft 60 is suitably secured in channel member 40 at one of its ends 313 and the plate 304 at its other end 315, with suitable step drive pulley 64 being received over one end of the shell 312 and welded thereto as indicated at 316, or otherwise suitably keyed thereto.

Roller shell 312, which is conveniently formed from steel or the like, is provided with a crown 67 that is preferably formed from nitrile rubber or other suitable equivalent elastomer, that may be molded in place on shell 312, for belt centering purposes and provides, in accordance with the invention, for increased coefficient of static friction of the roller crown surfacing 69 that engages the belt 24. Crown 67 has a length that approximates the width of belt 24 and defines crown surfacing 69 that is of the special shaping shown in FIG. 9, for centering the nylon belt of this invention. Crown 67 thus defines a cylindrically contoured center or midportion 67A that in length approximates one half the width of belt 24, and frusto-conical end portions 67B and 67C that have their larger ends merging with midportion 67A at merge lines 67D and 69E. End portions 67B and 67C each have a length that approximates one quarter of the width of belt 24.

The tail roller 22 is arranged in the same manner as the head roller 20 (see FIG. 14), and thus comprises roller shell 312A journalled on shaft 70 by suitable ball bearing units 314A at either end of same. Shaft 70 has its ends mounted in the respective suitable slidable support plates 72 and 74, with the ends of shaft 70 being threadedly connected to the respective bolts 76 and 78 that have their respective heads 80 and 82 seated against the respective abutment plates 84 and 86 suitably affixed to the ends of the frame members 40 and 42 at the tail end 18 of the frame 12, to provide for both spacing and angulation movement of the tail roller 22 relative to the head roller 20 to tension the belt 24 as desired and maintain same centered on rollers 20 and 22 during operation of exerciser 10. Tail roller shell 312A has applied to same the crown 85, also formed from the same materials as crown 67 (which may be molded in place) that forms crown surfacing 87 which crown 85 and surfacing 87 are similar to the crown 67 and surfacing 69 of the head roller 20; crown 85 defines cylindrically contoured center or midportion 85A that in length approximates one half the width of belt 24, and frusto-conical end portions 85B and 85C that have their larger ends merging with midportion 85A at merge lines 85D and 85E. End portions 85B and 85C each have a length that approximates one quarter of the width of belt 24. For tail roller 22, crown 85 is centered thereon. In the preferred embodiment, crown portions 67A and 85A have a diameter of 1.660 inches and the crown frusto-conical portions 67B, 67C, 85B and 85C taper to 1.625 inches at their opposed ends.

In the assembly of frame 12, and in particular slider bed 14, rollers 20 and 22, and belt 24, the bearings 72 and 74 of roller 22 are positioned so that belt 24 is stretched in the range of from about $\frac{3}{8}$ths inch to about $\frac{1}{2}$ inch at its central portion that engages crown portions 67A and 85A, with the belt side edges 24A and 24B having full contact with the respective frusto-conical crown portions 67B, 67C, 85B and 85C of both rollers 20 and 22. Such side contact of the belt with the crowning of the rollers, in addition to the center crowning portions 67A and 85A, is essential to have full tracking of the belt 24 on its rollers.

The crowns 67 and 85 may also be in the form of wax free rubber nitrile tubes (so as to be free of "blooming" in use) suitably applied to the respective shells 312 and 312A. Crowns 67 and 85 may also be formed by molded in place polyurethane or other suitable elastomer.

A critical aspect of the invention is Applicant's discovery that the loads on the bearings in which the rollers 20 and 22 are journalled may be minimized when using nylon or the like belting of the type indicated riding on a slider bed surfacing 30 defined by sanded or abraded UHMW polyethylene (as described hereinbefore) by forming the crown of at least the driving roller 20 from a suitable elastomer, while retaining the basic metallic roller structure for strength and rigidity. Applicant's invention contemplates that to achieve desirable minimumization of the loads on the bearings in which rollers 20 and 22 are journalled, the static coefficient of friction of the elastomeric crown surfacing forming material to nylon should be a minimum of 0.3. Tests have shown that, for instance, nitrile rubber (50 durometer) relative to nylon has a static coefficient of friction of about 1.36 neoprene (65 durometer) has a corresponding coefficient of friction of about 1.31, SBR butadiene (65 durometer) has a corresponding coefficient of friction of about 0.89 and gum rubber (35 durometer) has a corresponding coefficient of friction of 0.37 these and other equivalent elastomers thus provide at least the indicated minimum coefficient of static friction and satisfy the invention requirements for use as the roller crowning. The result is that the treadmill frame 12 and the bearings for rollers 20 and 22 may be greatly simplified and of inexpensive design by reason of the substantial minimization of the bearing stress requirements, the bearing stress requirements, and driving energy requirements are correspondingly minimized. The nitrile rubber is preferred since as to nylon, it has a relatively high coefficient of dynamic friction (about 1.28) as a back up should belt slippage occur.

The invention thus contemplates that the treadmill nylon belt at at least the roller 20 (and specifically, its crown surfacing 69) should have a minimum coefficient of static friction of about 0.3, while the nylon belt along slider bed surface 30 should have a maximum coefficient of dynamic friction that is a maximum of about 0.15 for achieving the treadmill simplification and drive efficiencies of the invention. The tail roller 22 of the illustrated embodiment has the same type of crowning as the head roller, and thus belt 24 has the indicated minimum coefficient of static friction at head roller crown 85.

Frame 12 at its head end 16 includes a pair of slope adjusting support devices 102 and 104 that comprise device 25 and cooperate with frame cross member 100. The drive motor 106 (and associated parts) for driving belt 24 comprising drive apparatus 27 are also mounted at the frame head end 16.

The general arrangement of the frame cross member 100 and its slope adjusting support devices 102 and 104 is of special significance. As indicated in FIG. 1, it is a feature of the invention that for zero slope conditions, the slope adjusting devices 102 and 104 are to be in their retracted positions, but when the treadmill is elevated to its maximum design height, the devices 102 and 104 are to be in their extended positions relative to the frame 12 for slope defining purposes. It is apparent that for the treadmill 10, when in its maximum slope defining position, its stability needs for the head end 16 of the frame 12 are maximum, while in its zero slope defining position (the full line position of FIG. 1), its stability needs are minimal.

The invention contemplates that the treadmill assembly 10 will provide for a repositioning of the slope adjusting devices 102 and 104, which incidentally are the only means of support of the treadmill 10 at its forward end, so as to improve the stability they provide, as the treadmill position of maximum slope is approached and reached, in accordance with the increasing need for stabilization as the frame head end elevates. For this purpose, the Applicant's arrangement contemplates that the slope adjusting devices 102 and 104 will be disposed to operate about upright axes that are at an acute angle off perpendicular or normal relation with the plane of the slider bed 14, which acute angle is equal to the acute angle of the slider bed 14 relative to the horizontal that will provide the maximum slope of operation of the treadmill 10. Further, the slope adjusting devices 102 and 104 are to be of sufficient length to elevationally move cross member 100, and thus the treadmill frame 12 to the indicated slope maximum, while at the same time shifting the slope adjusting devices 102 and 104 from the forwardly angled relation, upwardly of the treadmill, that is illustrated in the full line showing of FIG. 1, to the substantially vertical relation that is illustrated in the phantom line position of FIG. 1, which disposes the slope adjusting members 102 and 104 for maximum bracing relation relative to the frame 12.

Figure 8:
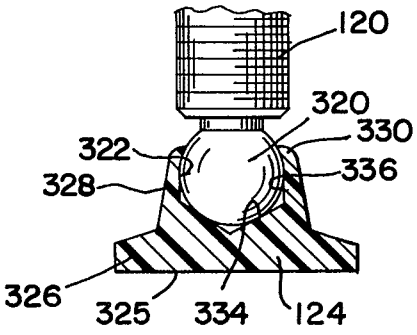
FIG. 8 is a fragmental sectional view of the lower end of one of the treadmill slider bed supporting screw members, illustrating its supporting foot and the manner in which the screw member is journalled in same.
Figure 3:
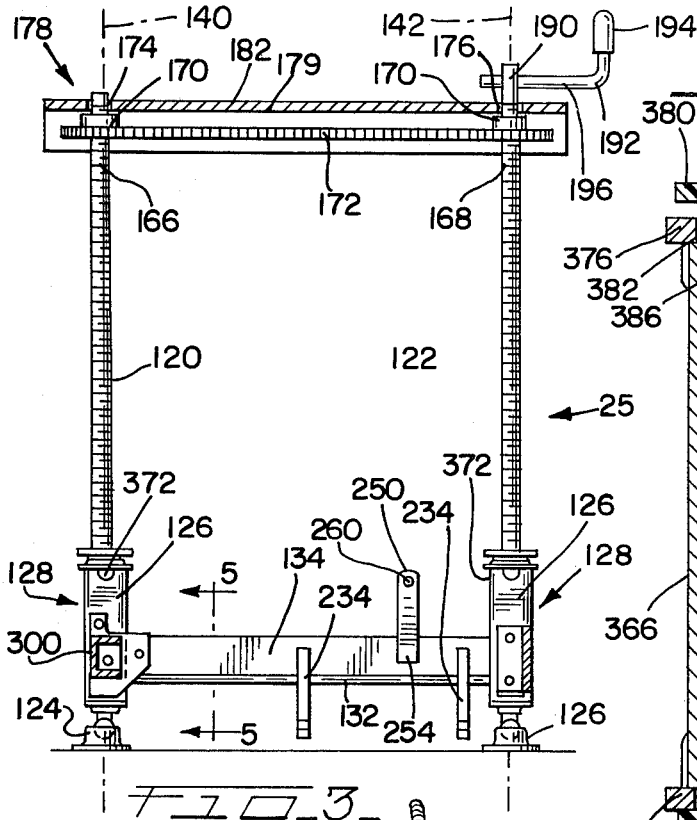
FIG. 3 is a vertical sectional view taken substantially along line 3—3 of FIG. 1, but with the operating motor assembly omitted to simplify the drawing.

In the specific arrangement illustrated, this aspect of the invention is provided by way of slope adjusting devices 102 and 104 each comprising the respective screw or threaded members 120 and 122 that are respectively equipped with the respective front feet 124 and 126 in the manner diagrammatically illustrated in FIG. 8 for the foot 124. The threaded members 120 and 122 are each respectively threadedly mounted in cross member 100 by a stationary nut assembly 128 that is more particularly illustrated in FIGS. 7 and 11, and which will be described in detail hereinafter.

Figure 5:
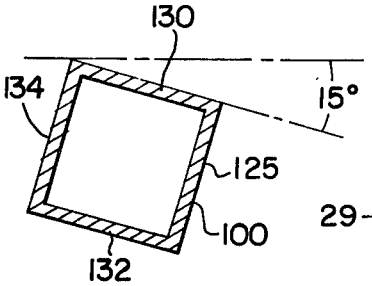
FIG. 5 is a fragmental sectional view taken along line 5—5 of FIG. 3, on an enlarged scale.
Figure 6:
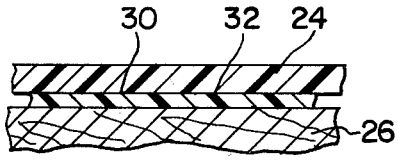
FIG. 6 is a fragmental sectional view on an enlarged scale illustrating a section through the belt and slider bed and showing the nylon sheeting that forms the slider bed top surfacing across which the upper run of the nylon belt rides.

In the specific form illustrated, cross member 100 is of quadrilateral tubular transverse cross-sectional configuration (approximately square in the illustrated embodiment, see FIG. 5) and defines top wall 130, bottom wall 132, rear wall 134 and forward wall 135, as illustrated in FIG. 5.

The nut assemblies 128 each comprise in the illustrated form a tubular member or shell or sleeve 136 of quadrilateral transverse cross-sectional configuration (square in the illustrated embodiment) with shells 136 suitably fixed to either end of the cross member 100, as by employing welding, so as to be an integral part of the cross member 100. Each shell 136 has applied to either end of same nut elements 138 and 138A that are formed, for instance, from nylon or the molybdenum disulphide filled nylon product sold under the brand name Nylatron GS (by the Polymer Corporation, of Reading, Pa.), and keyed to the sleeve 136 in the manner described in detail hereinafter, and that are suitably internally threaded and oriented to complement the threading of the respective threaded members 120 and 122 for threaded relation thereto. Suitable roll formed threading of any suitable type may be employed for this purpose, as will be hereinafter made clear.

The sleeves 136 of nut assemblies 128 are fixed (as by welding) to the cross member 100 (and thus are a part of same) so that the axes of rotational operation 140 and 142 of the respective devices 102 and 104 will be perpendicular to the planes of top and bottom walls 130 and 132 of the cross member 100 and be centered between the planes of side walls 134 and 135 of same (as indicated by the showing of FIG. 1). However, the cross member 100 and the nut devices 128 affixed thereto at either end of same are secured into the frame 12 in angled relation thereto, as is also indicated in the showing of FIG. 1 as well as FIGS. 5 and 10. In this angled relationship, the cross member 100 and its associated nut devices 128 are oriented relative to the plane of the slider bed 14 and its frame 12 so that the top and bottom walls 130 and 132 of the cross member are angled at an acute angle relative to the plane of slider bed 14 and frame 12, with the result that the axes of rotational operation 140 and 142 of the respective slope adjusting devices 102 and 104 are angled at the same acute angle off the vertical when the frame 12 is horizontally disposed. In this position of the frame 12, the operational axes 140 and 142, in addition to lying in parallel vertical planes that extend longitudinally of the frame 12, also project forwardly of the unit 10 upwardly of the frame 12.

As has been indicated, the treadmill assembly 10 is arranged and proportioned to provide a maximum slope of approximately twenty-five percent in its position of maximum inclination, which translates into an angulation of approximately 15 degrees relative to the horizontal, as indicated in FIG. 1 (an angulation of 15 degrees by tangent angle definition equals a 26.8 percent slope). In accordance with the invention, the cross member 100 and its nut devices 128 are fixed to frame 12 to dispose its top and bottom walls 130 and 132 at an angle of approximately 15 degrees relative to the plane of the frame 12, and thus dispose the operating axes 140 and 142 of devices 102 and 104 at an angle of approximately 15 degrees off the vertical when the frame 12 is in its horizontal relation shown in FIG. 1.

In the treadmill apparatus 10, the projecting end 300 of the channel member 40 and the forwardly extending end 306 of the plate 304 have the respective mounting plate structures 309 and 311 affixed thereto and are angled with respect to the plane of the frame 12 at an angle of 75 degrees to achieve the aforementioned angulation of the cross member 100 relative to the horizontal, by the respective mounting plate structures 309 and 311 being suitably affixed to the respective shells 136, as by employing welding, screw type fasteners, or the like. The frame 12 thus defines a downwardly angled forward end portion 310 that lies in a plane that is at an angle of 75 degrees relative to the plane of the basic frame 12, as indicated in FIG. 1. Cross member 100 in treadmill 10 thus is joined in the frame 12 to have its top and bottom walls 130 and 132 perpendicular to the plane of the frame portion 310, but at the indicated angle of approximately 15 degrees relative to the plane of the basic frame 12, as indicated in FIG. 1, in which cross member 100 lies. When frame 12 is at the zero slope position, slope adjusting devices 102 and 104 are disposed at a fifteen degree angulation off the vertical.

As has also been indicated, the respective screw members 120 and 122 are journalled in their respective feet 124 and 126, which are diagrammatically illustrated in FIG. 8 in the specific showing of foot 124. Thus, the threaded members 120 and 122 at their lower ends are formed with a ball terminal portion 320 which is received in the socket 322 of foot 124 that is formed from a suitable plastic material such as nylon or the like. The foot 124 defines a planar sole portion 325 that forms one side of disc portion 326, with the socket 322 being defined by an annular wall structure 328 projecting from the disc portion 326 that tapers upwardly of the disc portion 326 into a resiliently flexible continuous lip 330 which is proportioned such that the ball terminal portion 320 may be snap fitted into the socket 322 for permanent retention of the foot 124 on the ball 320. The foot 124 defines the internal conical surface 334 against which the ball portion 320 rockably and rotatably engages, and upstanding annular wall surface 336 that confines the ball 320 centrally of the foot 124. Lip 330 may be formed with a plurality of spaced marginal notches for facilitationg application of the feet 124 and 126 to the respective balls 320.

Thus, the slope adjusting support devices 102 and 104 as equipped with the feet 124 and 126 are rotatably and rockably mounted within the respective feet 124 and 126 which in turn have their undersurfaces 324 in flush engagement with the apparatus supporting surface 340.

The threaded members 120 and 122 at their respective upper ends 166 and 168 are each equipped with a chain drive sprocket 170 over which endless drive chain 172 is trained. The upper ends 166 and 168 of the respective threaded members 120 and 122 are also suitably journalled, as indicated at 174 and 176, in chain drive cover 178.

The cover 178 as illustrated comprises a shield 179 in the form of channel shaped member 180 having web portion 182 in which the upper ends 166 and 168 of the respective threaded members 120 and 122 are journalled, and depending side flanges 184 and 186 which extend downwardly sufficiently from the web portion to overlie and mask drive chain 172. In the form shown, the channel member 180 is of sufficient length to cover both ends of the drive chain 172 as it is disposed in trained relation over the sprockets 170, but if so desired, the cover 178 could be provided with rounded end portions that join the cover flanges 184 and 186 at either end of the cover 178.

The upper end 168 of the threaded member 122 is extended where indicated at 190 and has removably applied to same crank handle 192 comprising hand gripping portion 194 at right angles to stem portion 196 which in turn is suitably removably received in a bore formed in the end portion 190 in close fitting, radial relation thereto.

It will thus be observed that by rotating operating handle 192 about the operating axis 142 of the threaded member 122, both the devices 102 and 104 will be simultaneously operated about their respective operational axes 140 and 142 by way of the coupling provided by drive chain 172 and the cooperating sprockets 170. Thus, the threaded members 120 and 122 may be turned in one direction about their respective axes 140 and 142 to shift the frame 12 from its horizontally disposed position of FIG. 1, in which the devices 102 and 104 are in their retracted relations, to the maximum slope position shown in the phantom line position of FIG. 1, in which the devices 102 and 104 are in their extended relations. As already indicated, the threaded members 120 and 122, in moving from the full line position of FIG. 1 to the phantom line position thereof, rock rearwardly of the threadmill from the upwardly angled relation shown in the full line position of FIG. 1 to the substantially vertical relation shown in the phantom line position of FIG. 1.

Rotation of the threaded members 120 and 122 in the opposite direction returns the treadmill to the full line position of FIG. 1, whereby the devices 102 and 104 are returned from their extended relations to their retracted relations. Regardless of which direction the members 120 and 122 are operated, their threaded connections with the frame cross member 100 through nut devices 128 move the cross member 100 longitudinally of the respective members 120 and 122 to achieve the changes of slope of the treadmill 10 as may be desired.

The frame 12 at its rear end 18 is equipped with a pair of leg structures 200 and 202. In the form diagrammatically illustrated, frame 12 has angle member 201 affixed to the underside of same, as by employing two of the screws or bolts 54 applied to the flange 203 of member 201 for this purpose; angle member 201 has end plates 204 affixed to either end thereof, to each of which is respectively pivotally connected the respective rear feet 205 and 206, as by employing suitable pins 207. Feet 205 and 206 are formed from nylon or the like and have flat floor engaging surfaces 208, and space integral sleeve portions 209 that, for each of the feet 205 and 206, receive the respective pins 207. Frame 12 pivots at pins 207 with respect to feet 205 and 206 in being moved between the positions indicated in FIG. 1. Plates 204 are also each bolted to the frame members 40 and 42, respectively by suitable screw fastener devices 211.

The foot structures 200 and 202 and the feet 124 and 126 of the respective devices 102 and 104 are proportioned such that when the treadmill assembly 10 rests on horizontal supporting surface 340 (that is intended to represent a floor or the like), and the slope adjusting devices 102 and 104 are in their retracted relations, the frame 12 and its slider bed 14 will be horizontally disposed.

It is also to be noted that the pivotal connections of frame 12 that accommodate the zero to maximum slope positions indicated in FIG. 1 are at the feet 124, 126 and 205 and 206. The cross member 100 is a rigidly connected part of frame 12, and is rigidly connected to the respective sleeves 136 of the respective nut assemblies 128. Thus, frame 12 is stablely connected to nut assemblies 128 in non-pivotal relation thereto, with the necessary pivotal action needed to accommodate the desired slope positioning of frame 12 taking place as its feet 124, 126, 205 and 206.

The step drive assembly 222 comprises suitable stepping pulley 224 mounted on and keyed to motor shaft 226 in proper coplanar alignment with stepping pulley 64, and is keyed to roller shell 312, with pulley belt 228 being optionally applied to the sets of coplanar related pulley grooves of the pulleys 64 and 224 such that the belt 24 will be driven at one of the speeds indicated, namely 2, 2.9, or 3.5 miles per hour, at the user's option. These speeds are suitable for walking exercise purposes. As slider bed surfacing 30 has a coefficient of dynamic friction of about 0.15 or less relative to a belt 24 formed from nylon, and the elastomeric crowning of the head and tail rollers provides a coefficient of static friction between the belt 24 and rollers 20 and 22 that is at least about 0.3, a one-third horsepower motor will satisfy the power requirements for a two hundred fifty to three hundred pound individual using treadmill 10, for example.

Affixed to the cross member 100 is bracket 250 in the form of plate 252 that has its lower end 254 affixed to the side wall 134 of the cross member 100, as by employing welding. The plate 252 defines upstanding end portion 256 which is formed with aperture 260 through which extends the threaded shank 262 of screw member 264 which extends through aperture 265 formed in upstanding end 266 of plate 267 that is fixed, as by welding to the motor 106, and specifically its housing 106A. Screw member 264 extends through compression spring 268 and spring seat 269, and is threadedly received through adjusting nut 271 that seats against washer 270 abutting plate end 266. Nut 271 is positioned on screw member 264 to compress spring 268 between plate end portion 256 and spring seat 269 so as to provide tensioning device 223 for giving belt 228 the desired tension. This arrangement provides that belt 228 will operate under constant tension and will not be overstressed, as load surges are absorbed by spring 268. Plate 267 is formed to define handle 272 extending rearwardly of the treadmill so that the user of the treadmill, if he desires to change the driving speed of belt 24, may depress handle 272 downwardly, as indicated in full lines in FIG. 10, to compress spring 268 and fully relieve the tension in pulley belt 228 for ease of changing its position relative to pulleys 64 and 224, with one hand while holding handle 272 depressed with his other hand. On effecting the desired repositioning of pulley belt 228, handle 272 is released for application of tension thereto by device 223. Nut 271 may be adjusted as needed, relative to screw member 264 to apply the desired amount of tension to belt 228. The location of the pivot axis for motor 106 is disposed well below the plane of frame 12, and the common plane of the axes of rotation of motor shaft 226 and head roller shaft 60, to provide the bell crank action needed for this functioning of parts (see FIG. 10).

The hand holds 29 of treadmill 10 each comprise a fixed side railing 280 that is in the form of brace member 282 suitably shaped from rod or pipe stock to define upright legs 284 and rectilinear bight or hand hold portion 286 that are shaped to define a configuration resembling the letter "P", of which head portion 285 defines rearwardly extending loop portion 287. The railings 280 are of tubular metallic structure, with the rear legs 284 being enlarged as at 289 to receive the respective upstanding ends 290 of support 291 that is fixed to frame 12 in the manner suggested in FIGS. 1, 4, 10 and 13, wherein support 291, which also may be of suitable metallic tubular construction, have a pair of angle brackets 292 affixed thereto, as by welding at 293, with the respective brackets 292 being affixed to frame by a set of the aforedescribed screw members 54 having the functions indicated in FIG. 15. The front or forward legs 284 are similarly mounted in place by identical components, as indicated by corresponding reference numerals, side railings 280 being anchored in place by suitable screw fasteners 294 (see FIG. 1).

Figure 4:
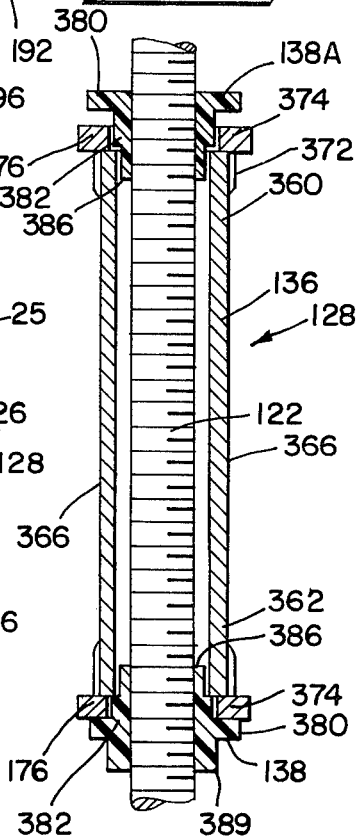
FIG. 4 is a vertical cross-sectional view taken substantially along line 4—4 of FIG. 1, illustrating the general arrangement of the slider bed and belt that is trained over same, and the slider bed hand holds on either side of same.

Railings 280 are proportioned in length and outwardly angled as indicated in FIG. 4 so that the user when mounting the threadmill apparatus with the belt 24 moving may grasp the hand hold portion 286 of hand rail 280 at the side of the treadmill that he is mounting it from, facing to the right of FIG. 1, as needed to steady himself, and simultaneously reach over the treadmill 10, while still standing beside it, and grasp the hand hold portion of the other railing 280, and then lift and swing his legs, one at a time, with the leg nearest the treadmill first, onto the belt 24 under the railing loop portion 287. The user may then continue his grasp on the hand hold portions of railings 280 to steady himself, as needed, while working out (walking) on the treadmill.

Figure 7:
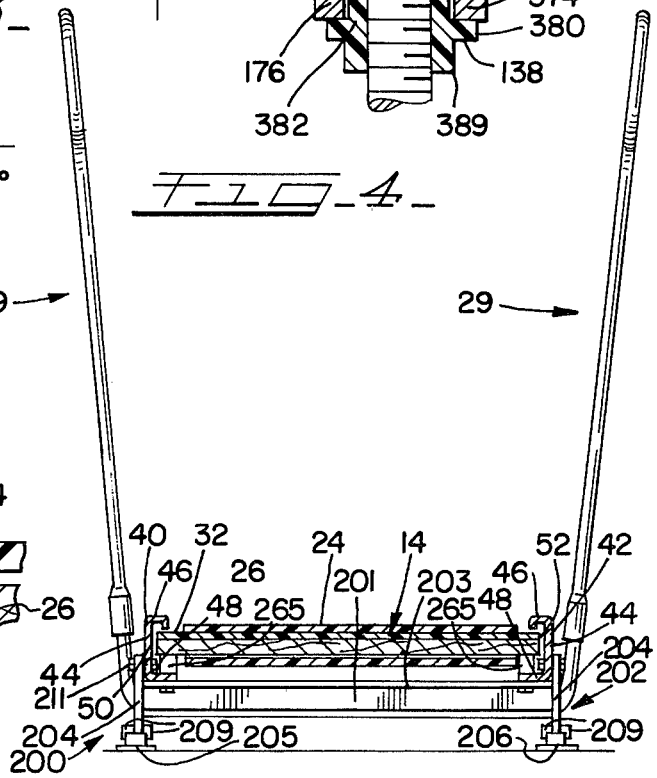
FIG. 7 is a diagrammatic fragmental view taken along line 7—7 of FIG. 1, on an enlarged scale, illustrating the novel nut assembly arrangement that forms a part of the illustrated embodiment.
Figures 10, 11, 12, 13, 14:
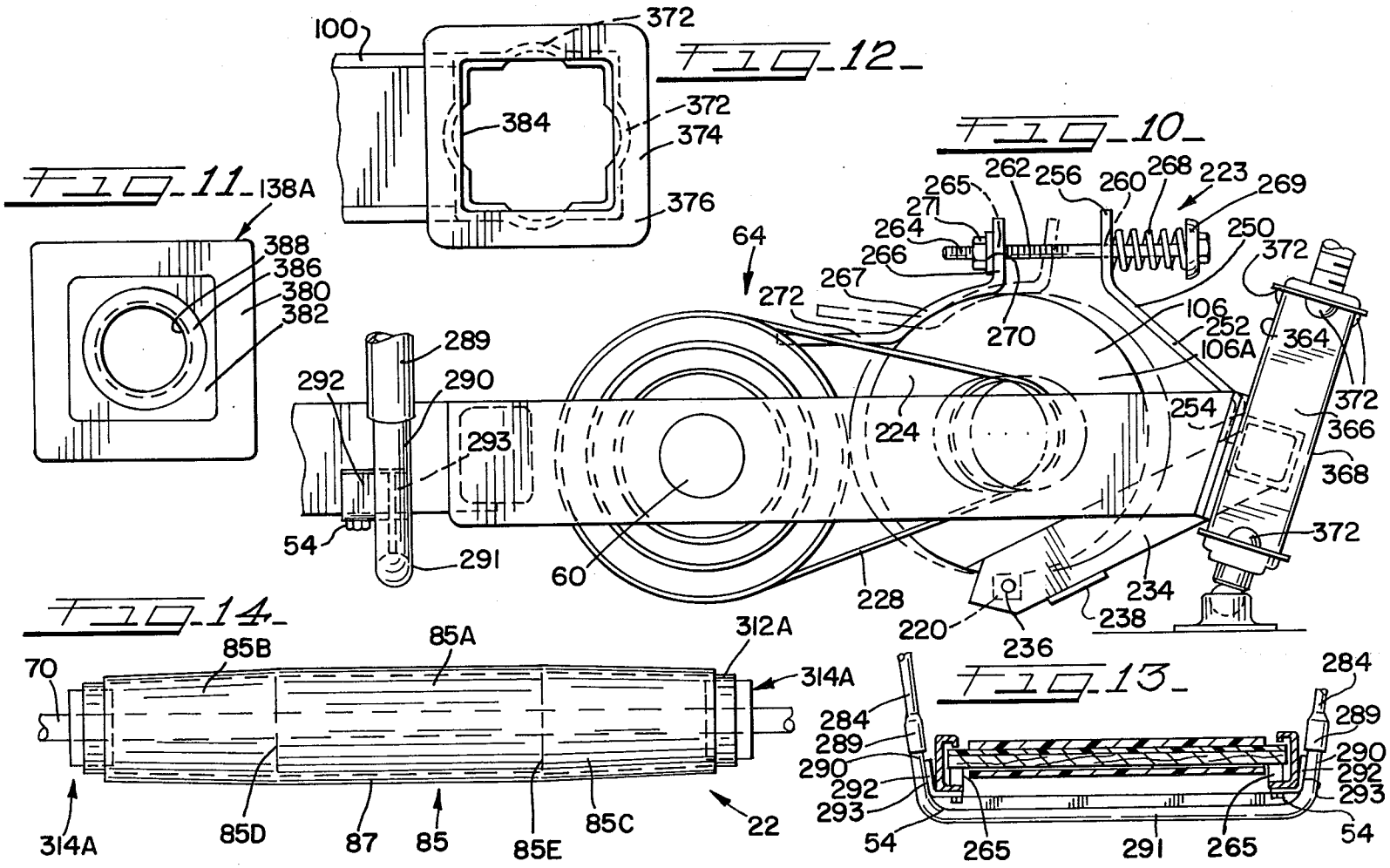
FIG. 10 is a fragmental side elevational view of the head end of the slider bed frame and the drive motor assembly associated therewith, on an enlarged scale, and diagrammatically illustrating the spring biased pulley belt tensioning arrangement and manual release therefor that forms a part of the invention.
FIG. 11 is a plan view of one of the nut members involved in the nut assembly of this invention.
FIG. 12 is a top plan view of one of the nut assembly mounting sleeves, with the nut element omitted.
FIG. 13 is a sectional view along line 13—13 of FIG. 1, further illustrating the manner of securing the hand holds to the slider bed frame.
FIG. 14 is a plan view of the slider bed tail roller.

Referring now more specifically to FIGS. 7, 11 and 12, the sleeves 136 of nut assemblies 128 at their upper and lower ends 360 and 362 are outwardly indented at the midportion of their respective sides 364, 366, 368, and 370, where indicated at 372 to freely accommodate the respective nut elements, which are similar nut 138A being shown in detail in FIG. 11. The sleeves 136 at their respective ends 360 and 362 have fixed to same, as by welding, an open centered plate 374 that is shown in plan in FIG. 12, that form the respective end flanges 376 of sleeves 136 at either end of same. The nut elements 138 and 138A each define quadrilateral flange portion 380 that has marginal dimensioning comparable to the outer marginal dimensioning of plates 374, a quadrilateral stud portion 382 shaped to be substantially complemental to the quadrilaterally contoured open center 384 of plates 374, and a cylindrical stud portion 386 proportioned to fit within the sleeve ends 360 and 362 and that is internally threaded as at 388 for threaded engagement with the respective threaded members 122 and 124. Nut 138 includes cylindrical stud portion 389 of increased wall thickness that extends oppositely of its stud portion 386 to increase its section and threaded engagement with the threaded members 120 or 122 they cooperate with since nuts 138 are primary load bearing components.

The nut assemblies 128 are assembled as indicated in FIG. 7, without having to fix or bond nut elements 138 and 138A to the respective sleeves 136. For this purpose, the threaded members 120 and 122 are threaded through the nuts 138 and 138A of a particular assembly 128, with the parts thereof oriented as suggested in FIGS. 1, 3, 7 and 10, with the result that cross member 100 rests on the lower nut elements 138 through its sleeves 136, and the nuts 138A are free to float longitudinally of the respective threaded member, axes 140 and 142, with respect to their sleeves 136, to accommodate tolerance variations in the formation of the threading of the steel members 120 and 122, as well as the differences in the coefficients of thermal expansion of the nut elements and steel. The nut elements 138A thus normally may have their flange portions 380 spaced somewhat from the sleeve upper end flanges 376, in accommodating such variations, which permit the use of any suitable rolled threading in forming threaded members 120 and 122. The outward indentations 372 of sleeves shape same to freely receive the nut element stud portion 386. Nut elements 138 and 138A are preferably formed from a suitable self lubricating material, such as the aforeindicated nylon.

It will be apparent that in the apparatus 10, rotation of operating handle 192 about the axis 142 of threaded member 122 will simultaneously operate both the slope adjusting support devices 102 and 104 in the manner already described. Thus, the threaded members 120 and 122 of the apparatus 10 may be turned in one direction about the respective axes 140 and 142 to shift the frame 12 from its horizontally disposed full line position of FIG. 1, in which the devices 102 and 104 are in their retracted relations, to the maximum slope position shown in the phantom line showing of FIG. 1, in which the devices 102 and 104 are in their extended relations, and frame 12 is disposed at an approximate 15 degree angulation with respect to the horizontal, with its frame portion 310 substantially vertically disposed and the threaded members 120 and 122 of the respective devices 102 and 104 positioned substantially vertically, and having been rocked rearwardly of the treadmill from their upwardly angled relation shown in the full line position of FIG. 1.

Operation of the devices 102 and 104 in the opposite direction rotates the threaded member 120 and 122 thereof in the opposite direction to return the threadmill to its full line relation indicated in FIG. 1, whereby the devices 102 and 104 are returned from their extended relations to the retracted relations.

As is clear from the application drawings, the treadmill front feet 124 and 126, and rear feet 205 and 206 are not physically connected to the floor surface 340, but do rest on same. Also, frame 12 is not pivotally connected to cross member 100, but rather is rigidly connected thereto, with the sleeves 136 of nut assemblies 128 resting on nuts 138, for stability, as already described. The pivotal action in frame 12 that accommodates its changes in slope occur only at the pivotal connections of feet 124 and 126 to the respective threaded members 120 and 122, and at the pivotal connections of feet 205 and 206 to the respective plates 204.

It has been found that when the frame 12 is moved from its horizontal position to its maximum slope position, while front feet 124 and 126 remain stationary, rear feet 205 and 206 slide forwardly a short distance, approximately 1¾ inch in a successful embodiment of the invention, as indicated by the showing of FIG. 1. Thus, the special nature of Applicant's treadmill 10 requires that its rear feet 205 and 206 be in free sliding or floating relation to the floor surface 340 supporting treadmill 10.

It will thus be seen that the treadmill assembly of the present invention provides a simplified, complication free exercise apparatus suitable for walking exercise at the pace and slope rate desired by the user. The slider bed and frame construction therefor are of minimal and simplified components arranged for ready securement together, economical electric energy driving requirements, rugged resistance to hard use. Jogging or trotting use may be provided for by providing a drive apparatus that will move the belt 24 at selected speeds of up to eight miles per hour.

The assembly 10 requires no instrumentation, and the adjustable simplified nature of the belt drive permits ease of manual adjustment for speed changes and off-on operation, and provides a constant and uniform tension on the drive pulley belt which is freed from overstressing possibilities. The simple slider bed surface for the nylon belt provides coefficient of dynamic friction characteristics that are lower than of canvas slider bed surfacings even where coated or impregnated with wax, graphite, or the like, while also eliminating the messiness that can accompany the use of such materials; canvas serving as slider bed material also tends to wrinkle as it wears, thus further increasing undesirably high coefficient friction relationships where they should be low.

The UHMW polyethylene material forming surface 30 preferably includes the indicated powdered carbon as this supplemental material has the effect of eliminating static friction build ups in the belt and slider bed that can result in the familiar winter weather type static shock when the user grasps the hand holds 29 (assuming the latter are formed from metal). The sanded nature of the preferred surface 30 reduces coefficient of friction characteristics by decreasing load bearing surfacing, and the resulting grooves serve to catch and hold dirt and other foreign material that otherwise could adversely effect operation of treadmill 10. The elastomeric material forming the belt head roller crowning increases the static coefficient of friction of this roller relative to the belt to levels that, with the indicated minimized coefficient of dynamic friction levels of the belt riding on the treadmill slider bed surface 30, insure minimum bearing stresses of rollers 20 and 22, and minimized drive energy requirements for treadmill 10. While the crowning of the trail roller is also of the same elastomeric matter, this is primarily a matter of convenience of manufacture, as it is the elastomeric nature of the drive roller crown that is critical.

The front and rear supporting feet for the assembly 10 in the zero slope position of FIG. 1 are highly effective in maintaining stability in use, with the angulation of the threaded members 120 and 122 in the zero slope position of the apparatus being of no significant effect due to the disposition of the cross member 100 in close adjacency to the feet of devices 102 and 104. As the treadmill apparatus is elevated to its maximum slope position, the slope adjusting devices 102 and 104 shift toward and to the stabilizing and vertically disposed position indicated in the phantom showing of FIG. 1.

Operation of the slope adjusting devices 102 and 104 is easy and effective, with the threaded mounting of the threaded members 120 and 122 in the cross member 100 and the journalling of their upper ends in cover 178 maintaining the threaded members 120 and 122 in uniform spaced apart parallel relation for effective simultaneous operational movement about their respective axes 140 and 142.

The proportioning and simplified nature of the treadmill assembly 10 makes it practical for the individual user to use and store same in his home. Shifting of the assembly is easily done by picking up the head end of same and pushing or pulling as needed.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an exercise treadmill including a generally planar slider bed having a head end, a tail end, and a top surfacing extending substantially between said ends thereof, an endless belt trained over said slider bed defining an upper belt run overlying said slider bed top surfacing and a lower run passing under said slider bed, means for driving said belt for movement of said belt upper run from said head end to said tail end of said slider bed, said slider bed having secured to same adjacent said head end thereof a cross member extending transversely thereof, a pair of screw members threadedly mounted in said cross member in spaced apart relation and for rotation about upright axes that are in parallelism and that are at like acute angles with respect to the plane of said slider bed, with each of said screw members having a foot journalled thereof, and means for simultaneously rotating said screw members in the same direction in forward and reverse directions for threading said cross member longitudinally of said screw members to raise and lower said slider bed head end, the improvement wherein:

said cross member includes a pair of nut assemblies, with one of the screw members being threadedly received in one of said nut assemblies and the other of the screw members being threadedly received in the other of said nut assemblies, said nut assemblies each comprising:

a tubular member having a first nut member keyed to the lower end of same and a second nut member keyed to the upper end of same, with the screw member of each nut assembly being threadedly engaged by said nut members thereof, said cross member being in fixed relation to said slider bed and to said tubular members of said nut assemblies, said slider bed having spaced rear feet adjacent its tail end that are rockably connected thereto, said feet being proportioned to support said slider bed with said plane thereof horizontally disposed when said screw members are in their retracted positions relative to said cross member with the screw member threaded portions thereof being largely disposed above said cross member, said screw member threaded portions being proportioned in length such that when said screw member threaded portions are in their extended positions relative to said cross member, with said screw member threaded portions thereof being largely disposed below said cross member, said slider bed is disposed at the acute angle that complements said acute angles, relative to the horizontal, said screw members in their said retracted positions being at said acute angles relative to the horizontal and said screw members in their said extended positions being substantially vertically disposed, and said rear feet being moved by said slider bed toward said feet of said screw members when said screw members are moved to their said extended positions, and said rear feet being moved by said slider bed away from said feet of said screw members when said screw members are moved to their said retracted positions.

2. The improvement set forth in claim 1 wherein:

said feet each have a planar sole.

3. The improvement set forth in claim 1 wherein:

said belt is formed from nylon, said slider bed top surfacing being formed by plastic sheeting on which said belt upper run rides, said slider bed at its head and tail ends has head and tail rollers journalled thereon, with said belt being trained over said rollers, said rollers each having an elastomeric crown against which said belt bears.

4. The improvement set forth in claim 3 wherein:

said elastomeric crown is formed by nitrile rubber anchored to a metal core defined by said rollers, and said slider bed top surfacing sheeting is nylon.

5. The improvement set forth in claim 4 wherein:

said crown of said rollers, respectively, define crown surfacing for said rollers that is of right cylinder configuration at the midportions thereof and of frusto-conical configuration at the end portions thereof having their larger ends merging with said cylindrical crown surfacing of said rollers respectively, said rollers being spaced apart to train said belt in stretched relation, with the side edges of said belt being in riding relation to said roller end portions respectively.

6. The treadmill set forth in claim 1 wherein:

said complementing acute angle approximates fifteen degrees.

7. The treadmill set forth in claim 1 wherein:

said feet of said screw members have planar undersides and said treadmill pivots only at said feet when said slider bed is moved between its said horizontal and acute angle positions.

8. In an exercise treadmill including a generally planar slider bed having a head end, a tail end, and a top surfacing extending substantially between said ends thereof, an endless belt trained over said slider bed defining an upper belt run overlying said slider bed top surfacing and a lower run passing under said slider bed, means for driving said belt for movement of said belt upper run from said head end to said tail end of said slider bed, said slider bed having secured to same adjacent said head end thereof a cross member extending transversely thereof, a pair of screw members each defining a threaded portion that is threadedly mounted in said cross member in spaced apart relation and for rotation about upright axes that are in parallelism and that are at like acute angles with respect to the plane of said slider bed, with each of said screw members having a foot journaled thereon, and means for simultaneously rotating said screw members in the same direction in forward and reverse directions between retracted and extended positions thereof relative to said cross member for threading said cross member longitudinally of said screw members to raise and lower said slider bed head end, the improvement wherein:

said slider bed has spaced rear feet adjacent its tail end that are rockably connected thereto, said feet being proportioned to support said slider bed with said plane thereof horizontally disposed when said screw members are in their retracted positions relative to said cross member with the screw member threaded portions thereof being largely disposed above said cross member, said screw member threaded portions being proportioned in length such that when said screw member threaded portions are in their extended positions relative to said cross member, with said screw member threaded portions thereof being largely disposed below said cross member, said slider bed is disposed at the acute angle that complements said acute angles, relative to the horizontal, said screw members in their said retracted positions being at said acute angles relative to the horizontal and said screw members in their said extended positions being substantially vertically disposed, and said rear feet being moved by said slider bed toward said feet of said screw members when said screw members are moved to their said extended positions, and said rear feet being moved by said slider bed away from said feet of said screw members when said screw members are moved to their said retracted positions.

9. The improvement set forth in claim 8 wherein:

said feet each have a planar sole, said treadmill pivoting only at said feet when said slider bed is moved between its said horizontal acute angle positions.

* * * * *